United States Patent [19]

Sugita et al.

[11] Patent Number: 4,573,499

[45] Date of Patent: Mar. 4, 1986

[54] WEFT DETECTION STOPPER FOR LOOMS

[75] Inventors: Katsuhiko Sugita, Kanazawa, Japan; Makoto Uehara, Charlotte, N.C.

[73] Assignee: Tsudakoma Kogyo Kabushiki Kaisha, Japan

[21] Appl. No.: 593,817

[22] Filed: Mar. 27, 1984

[30] Foreign Application Priority Data

Apr. 1, 1983 [JP] Japan ..... 58-058297

[51] Int. Cl.[4] ..... D03D 51/34

[52] U.S. Cl. ..... 139/370.2; 139/435

[58] Field of Search ..... 139/370.2; 250/559; 340/677

[56] References Cited

U.S. PATENT DOCUMENTS 4,178,590 12/1979 Weidmann ..... 340/677

4,215,728 8/1980 Weidmann et al. ..... 139/370.2

4,384,596 5/1983 Brouwer et al. ..... 139/370.2

*Primary Examiner*—Henry S. Jaudon

*Assistant Examiner*—Steven Shongut

*Attorney, Agent, or Firm*—Lerner, David, Littenberg, Krumholz & Mentlik

[57] ABSTRACT

Production of a weft defect on a cloth under weaving is detected by at least two weft detection units arranged side-by-side on a loom along the path of travel of inserted wefts for issuing a defect signal which is then subjected to automatic allocation of a corresponding penalty. Penalty-loaded defect signals are sequentially accumulated at a control counter so that the loom is stopped when a count at the control has exceeded a given threshold. When a defect is removed by manual mending on the loom during a dwell, a corresponding gain is automatically subtracted from the count at the control counter during sequential accumulation in order to subdue the count below the threshold and to allow restarting of the loom. Automatic inspection on the loom can be carried out on a level with conventional manual inspection of the loom.

9 Claims, 7 Drawing Figures

4
G
SW1
SW2
S10
S20
M10
M20
3
5
31
32
T3
C3
DW
UP
RS
S3
H1
H2
A1
A2
S21
M21
S11
M11
T1
RS
C1
C4
X
1

WEFT DETECTION STOPPER FOR LOOMS

BACKGROUND OF THE INVENTION

The present invention relates to a weft detection stopper for looms, and more particularly relates to a stopper for automatically stopping a loom upon discrimination of a condemnable cloth while automatically detecting type of weft defects.

At weaving factories, manual inspection is in general applied to each woven cloth and different penalties are allocated to different defects produced on the cloth. The penalties so alloted are sequentially added to each other over the prescribed entire length of the cloth so that grading of the cloth should be fixed in accordance with the grand sum of penalties. During the manual inspection, some defects are removed by manual mending and corresponding partial sum of penalties is subtracted from the grand sum of penalties for upgrading of a condemnable cloth. That is, allocation of penalties to defects is conventionally carried out manually.

It is also conventionally employed to manually stop a loom on finding of a defect on a cloth during production so that, when possible, the defect should be removed by manual mending during the dwell of the loom. However, stopping a loom during production tends to generate a weft stripe on the cloth and lowers production efficiency of the loom. Further, manual mending causes an increase in total labour for production. An idea has recently been developed in which neither stopping of a loom nor manual mending should preferably be arranged even when any defects appear on a cloth during production as long as the presence of such defects does not cause the production of a condemnable cloth.

On the basis of such a new idea, various devices have been proposed to detect appearance of weft defects during production on a loom and stop the loom in reference to the result of detection. In any case, however, only the number of defects which appear are detected for accumulation and the loom is automatically stopped when the accumulation exceeds a given allowable limit, a threshold value.

As mentioned already, weft defects of different types have different extents of quality damage and weft defects of different types appear quite at random during production of a cloth. It is assumed that a same threshold value is set for two different cloths. One cloth includes 10 weft defects of relatively small extents of quality damage and another cloth includes 10 weft defects of relatively large extents of quality damage. Then, the cloths are the same in the number of weft defects but different in grand sum of penalties. Different grading should correctly be applied to these cloths because of the difference in grand sum of penalties. In the case of the above-described conventional systems, grading is based on the number of weft defects whilst disregarding difference in extent of quality damage. So, as long as the two cloths are the same in total number of detects per a given unit length, the cloths are graded equally. In other words, the conventional systems cannot carry out grading of a cloth whilst taking into consideration the extents of quality damage by defects. As a consequence, the conventionally proposed automatic inspection systems are all very incomplete in quality control when compared with the manual, visual inspection.

SUMMARY OF THE INVENTION

It is the object of the present invention to enable automatic defect inspection on a loom on a level with manual, visual inspection whilst taking into consideration the extent of quality damage by each defect.

In accordance with the basic concept of the present invention, a plurality of weft detection units are arranged on a loom along the path of travel of an inserted weft so that defect signals should be generated by at least one of the weft detection units upon production of defects on a cloth under weaving. A penalty is allotted to each defect signal depending on the type of the detected defect. After allocation of penalties, penalty-loaded defect signals are accumulated from defect to defect and a stop signal for the loom is automatically issued when the grand sum of penalties, i.e. accumulation of penalties, exceeds a prescribed threshold value.

When manual mending is applied for removal of a defect during dwell of the loom, a mend signal is generated. A gain is allotted to each mend signal depending on the type of the mended defect. After allocation of the gain, each gain-loaded mend signal is used for subtracting the gain from the above-described accumulation of penalties so that a new grand sum of penalties should be subdued below the above-described threshold value. The loom is now ready for running for continued weaving of the cloth.

DESCRIPTION OF THE PREFERRED EMBODIMENTS

In accordance with the present invention, a plurality of weft detection units H1 to Hn are arranged side by side on a loom along the path of travel of an inserted weft and a defect signal, which is special to a produced defect, is formed from at least one of the detection signals issued by the weft detection units H1 to Hn. Photoelectric type feelers or electrode type feelers are used for the respective weft detection units H1 to Hn. It is not required to use the same type of feelers for all weft detection units. Various types of feelers may be used in combination depending on actual process conditions.

The following description is directed to a case in which weft detection units are all collectively arranged on the weft arrival side of the lathe. However, the present invention is not limited to such an arrangement. Some of the weft detection units may be arranged on the weft ejection side of the lathe. Further, the weft detection units may be arranged to being spaced from each other in an area between the weft ejection and arrival sides of the lathe.

A production plan at a weaving factory is in general fixed in reference to the level of quality required for cloths, allowable total labour for production, production efficiency and so on, and the production plan usually includes several basic rules. As the first rule, there is a case in which weaving should be discontinued when the grand sum of penalties on the cloth has exceeded the allowable maximum value for A-grade and the loom has stopped. At this moment, the woven length of the cloth on the loom is sometimes shorter than the unit length for one standard lot. But at weaving factories, woven cloths are often shipped in the form of a short lot whose length is $\frac{1}{2}$ or $\frac{1}{3}$ of the unit length of one standard lot. So, once some lowering in yield can be accepted, short lots of A-grade can be obtained even when weaving is discontinued in the above-described manner.

Figure 1:
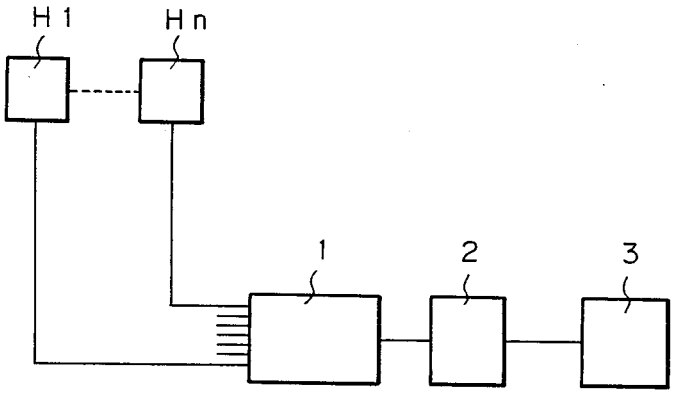
FIGS. 1 to 3 are block diagrams for showing basic constructions of various embodiments of the weft detection stopper in accordance with the present invention.

The arrangement shown in FIG. 1 is suited for production in which weaving is discontinued following the above-described first rule. In the arrangement, a plurality of weft detection units H1 to Hn are connected to a loom stop circuit 3 via a penalty allocation circuit 1 and a control counter 2. A defect signal is formed from at least one of the detection signals issued by the weft detection units H1 to Hn. On receipt of each defect signal, the penalty allocation circuit 1 allots a penalty to the defect signal which is special to the penalty represented by the defect signal and issues a corresponding penalty-loaded defect signal. In this case, the control counter 2 takes the form of an accumulator which sequentially accumulates a series of penalty-loaded defect signals from the penalty allocation circuit 1. When an accumulation exceeds a threshold value which is given in the form of an allowable maximum value for A-grade, the control counter 2 issues a stop signal which drives the loom stop circuit 3. As a consequence, the loom stops.

As the second rule, there is a case in which, after the grand sum of penalties on the cloth has exceeded the allowable maximum value for A-grade and the loom has stopped, some defects are removed by manual mending in order to subdue the new grand sum of penalties below the above-described allowable maximum value for A-grade and the loom is restarted.

Figure 2:
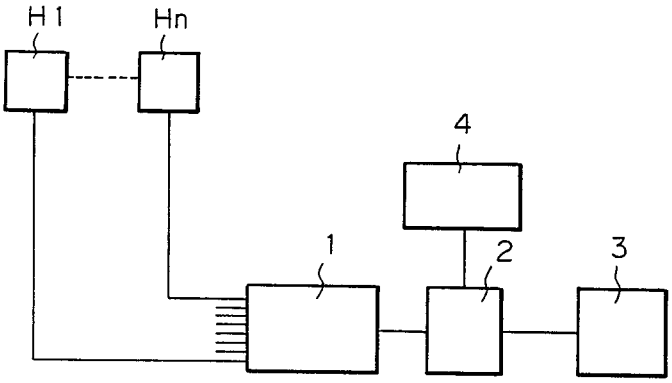

The arrangement shown in FIG. 2 is suited for production in which weaving is restarted following the above-described second rule. Like the foregoing arrangement, a plurality of weft detection units H1 to Hn are connected to a loom stop circuit 3 via a penalty allocation circuit 1 and a control counter 2 which, in this case, takes the form of a reversible counter. The penalty allocation circuit 1 is connected to an up-terminal of the control counter 2. Further, a gain allocation circuit 4 is connected to a down-terminal of the control counter 2. Every time a defect is removed by manual mending during dwell of the loom, a switch corresponding to that defect is manually depressed in order to generate a mend signal. Then, the gain allocation circuit 4 allots a gain to the mend signal which is special to the removed defect. It should be noted that the gain allotted here is equal to the penalty special to that particular defect. On receipt of each gain-loaded mend signal from the gain allocation circuit 4, the control counter 2 subtracts the gain from the grand sum of penalties and cancels drive on the loom stop circuit 3 when a new grand sum of penalties is subdued below the allowable maximum value for A-grade. The loom is now in a state able to restart.

As the third rule, there is a case in which, even when the grand sum of penalties has exceeded the allowable maximum value for A-grade and the loom has stopped, the loom is restarted for production of a B-grade cloth but the quality should not fall down to C-grade.

Figure 3:
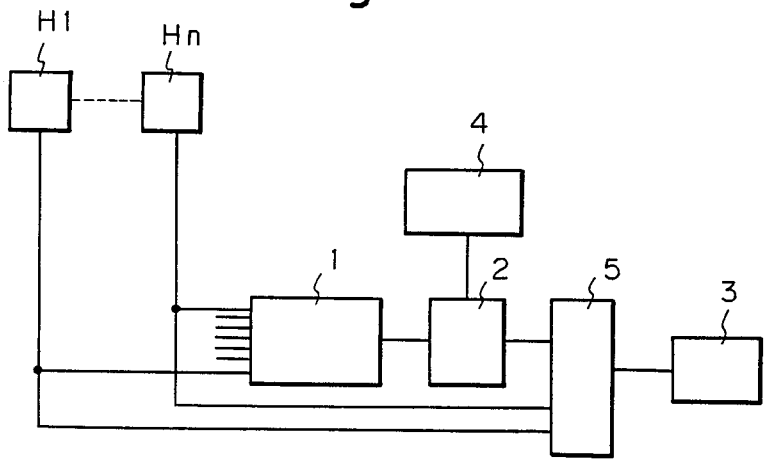

The arrangement shown in FIG. 3 is suited for production in which weaving is restarted following the above-described third rule. Like the foregoing arrangement, a penalty allocation circuit 1 is connected to an up-terminal of a control counter 2 and a gain allocation circuit 4 is connected to a down-terminal of the control counter 2. A short connection circuit 5 interposed between the control counter 2 and a loom stop circuit 3. The weft detection units H1 to Hn are also connected to the short connection circuit 5. After the loom has stopped on issue of a stop signal by the control counter, the short connection circuit 5 cancels the connection between the control counter 2 and the stop circuit 3 and, simultaneously, connects the weft detection units H1 to Hn directly to the loom stop circuit 3. Now the loom is put in a state able to restart.

In accordance with the basic aspect of the present invention, a penalty is allotted to each defect signal depending on the type of the defect represented by that defect signal whereas a gain is allotted to each mend signal depending on the type of the defect represented by that mend signal. This process will now be explained in more detail with reference to FIG. 4 in which two weft detection units H1 and H2 are used. It is assumed that the weft detection units H1 and H2 are arranged side by side on the weft arrival side outside the cloth edge. Only the inside weft detection unit H1 is arranged at a position where the leading end of a normally inserted weft can reach. The inside weft detection unit H1 issues a detection signal in the form of a pulse in the case of "weft absent", that is, it produces a pulse to indicate absence of weft.

Figure 4:
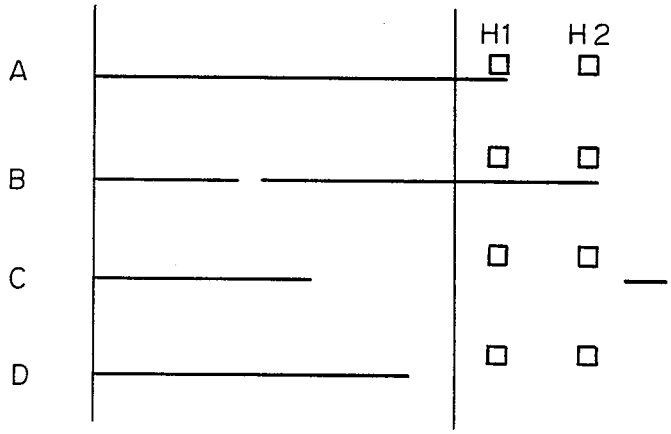
FIG. 4 is a plan view for showing one example of modes of weft insertion.

In FIG. 4, "A" indicates normal weft insertion, "B" indicates a defect called "intermediate breakage", "C" indicates a defect called "end blow-off", and "D" indicates a defect called "short pick". The modes of outputs from the weft detection units H1 and H2 for these cases are shown in positive logic as follows;

| | unit | |
|---|---|---|
| mode | H1 | H2 |
| A | 0 | 0 |
| B | 0 | 1 |
| C | 1 | 0 |
| D | 1 | 0 |

In connection with the above-described modes of weft insertion, the end blow-off (C) and the short pick (D) are graded as "light defects" and a penalty 1 is allotted to each corresponding defect signal (pulse) from the inside weft detection unit H1 at the penalty allocation circuit 1. The intermediate breakage is graded as "a medium defect" and a penalty 4 is allotted to a corresponding defect signal (pulse) from the outside weft detection unit H2 at the penalty allocation circuit 1. Further, when two light defects are produced in succession, they are in combination graded as "heavy defects" and penalties 10 are allotted to two successive defect signals (pulses) from the inside weft detection unit H1. Grading of defects and corresponding allocation of penalties are not limited to the foregoing example. Penalties for different defects should be fixed in consideration of the level of quality required for the cloth to be produced.

In practice, the grade of a cloth is fixed in reference to the grand sum of penalties per unit length of a standard lot. In the following description, however, grading is performed in reference to the grand sum of penalties per 50 m. of cloth for convenience sake. The allowable maximum value for A-grade (threshold value) is set to 9 per 50 m. of cloth. That is, the loom should be stopped when the grand sum of penalties amounts to 10. However, the threshold value should not necessarily be set to the above-described example. Value setting is properly done in reference to the level of quality required for a cloth to be woven.

Figure 5:
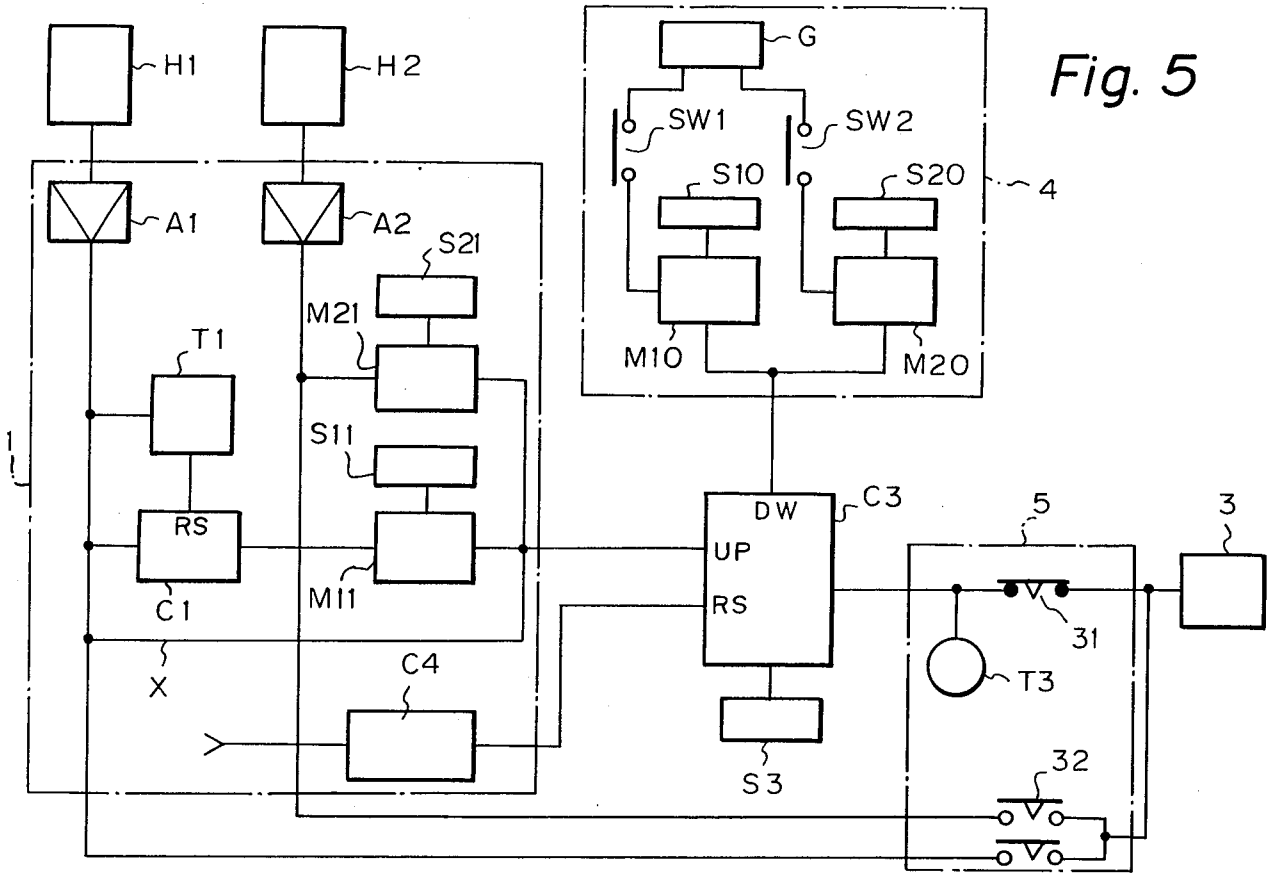
FIG. 5 is a circuit diagram of one example of the weft detection stopper in accordance with the present invention which carries out automatic defect inspection whilst discriminating the modes of weft insertion such as shown in FIG. 4.

The construction of the weft detection stopper shown in FIG. 3 is shown in more detail shown in FIG. 5. Here, one detection signal from each weft detection unit H1 or H2 corresponds to one defect signal. The inside weft detection unit H1 is connected to a up-terminal UP of a reversible counter C3 via an amplifier A1, a delay timer T1 and a fixed counter C1. The delay timer T1 is connected to a reset terminal RS of the fixed counter C1 and, upon receipt of a defect signal (pulse) from the inside weft detection unit H1, resets the fixed counter with two picks delay. The fixed counter C1 is set to 2 and issues a pulse signal when its count amounts to 2.

The fixed counter C1 is connected to the up-terminal UP of the reversible counter C3 via a pulse multiplier M11. By operation of an annexed setter S11, the pulse multiplier M11 is set to issue eight pulse signals on input of one pulse signal. The rate of multiplication can be freely adjusted by the setter S11.

The outside weft detection unit H2 is connected to the up-terminal UP of the reversible counter C3 via an amplifier A2 and a pulse multiplier M21. By operation of an attached setter S21, the pulse multiplier M21 is set to issue four pulse signals on receipt of one pulse signal. The rate of multiplication can be freely adjusted by the setter 21.

Here, the output-holding type reversible counter C3 is used for the control counter 2 shown in FIG. 2. By operation of an attached setter S3, the reversible counter C3 is set to issue a stop signal when its count, i.e. the grand sum of penalties amounts to 10. The setting of the reversible counter C3 can be freely adjusted depending on the size of the allowable maximum for A-grade.

A production counter C4 is connected to a reset terminal RS of the addition and subtraction counter C3. The production counter C4 is operationally coupled, for example, to the take-up mechanism of the loom and, when the woven length of the cloth amounts to 50 m., issues a pulse signal to reset the reversible counter C3.

On the output side, the reversible counter C3 is connected to a delay timer T3 and, further, to the loom stop circuit 3 via a normally closed contact 31 of the delay timer T3. The delay timer T3 with its contacts 31 and 32 forms the short connection circuit 5 shown in FIG. 3.

An electric power source G for the gain allocation circuit 4 is connected to a pulse multiplier M10 via a manual switch SW1 and to a pulse multiplier M20 via a manual switch SW2. The pulse multipliers M10 and M20 are both connected to the down-terminal DW of the reversible counter C3.

The pulse multiplier M10 corresponds to the pulse multiplier M11 used for the penalty allocation circuit 1. More specifically, every time a defect detected by the inside weft detection unit H1 is removed by manual mending, the manual switch SW1 is depressed by an operator so that one pulse signal should be passed from the electric power source to the pulse multiplier M10 which thereupon issues one pulse signal. On receipt of this pulse signal at the down-terminal DW, the reversible counter C3 subtracts 1 from its current count. This corresponds to a process in manual inspection in which a penalty 1 is removed from the cloth by manual mending. The rate of multiplication can be freely adjusted by an attached setter S10. When it is troublesome to separately depress the manual switch SW1 every time a light defect is removed by manual mending, the pulse multiplier M10 may be set, for example, to 2. Then, if the manual switch SW1 is depressed once per two times of light defect removal, the pulse multiplier M10 issues two pulse signals so that the reversible counter C3 subtracts 2 from its current count. This corresponds to a process in manual inspection in which a penalty 2 is removed from the cloth by manual mending.

The pulse multiplier M20 corresponds to the pulse multiplier M21 used for the penalty allocation circuit 1. More specifically, every time a defect detected by the outside weft detection unit H2 is removed by manual mending, the manual switch SW2 is depressed by the operator so that one pulse signal should be passed from the electric power source G to the pulse multiplier M20 which thereupon issues four pulse signals. On receipt of these pulse signals at the down-terminal DW, the reversible counter C3 subtracts 4 from it current count. This corresponds to a process in manual inspection in which a penalty 4 is removed from the cloth by manual mending. The rate of multiplication can be freely adjusted by an attached setter S20.

Separately from the foregoing arrangement, the inside weft detection unit H1 is directly connected to the loom stop circuit 3 via the amplifier A1 and the normally-open contact 32 of the delay timer T3 whereas the outside weft detection unit H2 is also directly connected to the loom stop circuit 3 via the amplifier A2 and the same contact 32 of the delay timer T3.

Next, the operation of the weft detection stopper shown in FIG. 5 will be explained while citing the modes of weft insertion shown in FIG. 4.

The case of the light defects to be detected by the inside weft detection unit H1 will be described first. In this case, the inside weft detection unit H1 issues one pulse signal which is passed to the delay timer T1, the fixed counter C1 and the up-terminal UP of the reversible counter C3. The delay timer T1 does not operate by two picks later. The fixed counter C1 does not issue any pulse signal at this moment since it is set to 2. The count 1 is reset to 0 two picks later by operation of the delay timer T1.

As a consequence, only one pulse signal from the inside weft detection unit H1 is put in the up-terminal of the reversible counter C3 whose count (the grand sum of penalties) amounts to 1. Since this count 1 is by far smaller than the threshold value 9, the reversible counter C3 does not issue any stop signal and the loom does not stop. In practice, the light and medium defects are produced quite at random on the cloth during weaving. However, simply assuming that light defects are produced for ten times in succession during weaving of 50 m. of cloth, the count (the grand sum of penalties) at the reversible counter C3 amounts to 10 surpassing the threshold value 9, and the reversible counter C3 issues a stop signal which drives the loom stop circuit 3 for operation. This stop signal is also passed to the delay timer T3 which is then turned on with a certain delay. As a result, the normally-closed contact 31 is opened while the normally-open contact 32 is closed. Thus, the weft detection units H1 and H2 are both directly connected to the loom stop circuit 3.

The case of the medium defects to be detected by the outside weft detection unit H2 will be described next. This corresponds to the mode (B) in FIG. 4. In this case, the outside weft detection unit H2 issues one pulse signal which is passed to the pulse multiplier M21. As a result, the pulse multiplier M21 passes four pulse signals to the up-terminal UP of the reversible counter C3 whose count (the grand sum of penalties) amounts to 4. Assuming that medium defects are produced for three times in succession during weaving of 50 m. of cloth, the count (the grand sum of penalties) at the reversible counter C3 amounts to 12 clearly surpassing the threshold value 9, and the reversible counter C3 issues a stop signal which drives the loom stop circuit 3 for operation. Like the case for the light defects, the delay timer T3 is turned on with the same delay so that the weft detection units H1 and H2 are directly connected to the loom stop circuit 3.

In the case of the heavy defects, the inside weft detection unit H1 issues two pulse signals in succession. In this case, the two successive pulse signals are passed in sequence to the delay timer T1, the fixed counter C1 and the up-terminal UP of the reversible counter C3. As a result, the count at the fixed counter C1 amounts to 2 before being reset by the delay timer T1 two picks later and one pulse signal is passed to the pulse multiplier M11. On receipt of the pulse signal, the pulse multiplier M11 issues eight pulse signals which are then passed to the up-terminal UP of the reversible counter C3. That is, the up-terminal UP of the reversible counter C3 receives in total ten pulse signals, two directly from the inside weft detection unit H1 via a connection X and eight from the pulse pultiplier M11. As a result, the count (the grand sum of penalties) at the reversible counter C3 amounts to 10 which is beyond the threshold value 9 and a stop signal is issued in order to drive the loom stop circuit 3 for operation. In this case also, the delay timer T3 is turned on with the certain delay so that the weft detection units H1 and H2 should be directly connected to the loom stop circuit 3.

As described already, defects of various extent are in general produced on a cloth at random during weaving. It is next assumed that three light defects to be detected by the inside weft detection unit H1 and two medium defects to be detected by the outside weft detection unit H2 are produced at random during weaving 50 m. of cloth. In this case the sequence of production does not matter. So, it may be assumed that the count (the grand sum of penalties) at the reversible counter C3 first amounts to 3 due to three pulse signals directly supplied by the inside weft detection unit H1. Next, on receipt of the first pulse signal from the outside weft detection unit H2, the pulse multiplier M21 issues four pulse signals which are then passed to the reversible counter C3. As a consequence, the count at the reversible counter C3 amounts to 7 which is below the threshold value 9 and no stop signal is issued as yet. However, on receipt of the second pulse signal from the outside weft detection unit H2, the pulse multiplier M21 again issues four pulse signals and the count at the reversible counter C3 amounts to 11 which is beyond the threshold value 9. Now a stop signal is issued by the reversible counter C3 to drive the loom stop circuit for operation. In this case also, the delay timer T3 is turned on with the certain delay so that the weft detection units H1 and H2 should be directly connected to the loom stop circuit 3.

What action should be taken after the loom has stopped by operation of the loom stop circuit 3 is fixed depending on the production plan employed. In any case, however, the production counter C4 issues one pulse signal to reset the reversible counter C3 when 50 m. of cloth has been woven. As a result, the count at the reversible counter C3 amounts to 0 so that no stop signal should be issued. Now the delay timer T3 is turned off so that the normally-closed contact 31 should be closed and the normally-open contact 32 should be opened. As a result, the illustrated state is restored and the weft detection units H1 and H2 are now relieved from the direct connection of the loom stop circuit 3.

Mending of defects is carried out as follows. When production is focussed upon high yield of A-grade cloths according to the above-described second basic rule, it is desirable to remove as many defects as possible during dwells of a loom. Needless to say, total labour for production and production efficiency have to be taken into consideration. It is now assumed that the loom has stopped due to count 11 at the reversible counter C3. After removal of one light defect by manual mending, the manual switch SW1 may be depressed once. Next, after removal of one medium defect, the manual switch SW2 may be depressed once. Then, the down-terminal DW of the reversible counter C3 in total receives five pulse signals. As a result of subtraction of 5 from the initial count 11, the new count at the reversible counter C3 amounts to 6 which is below the threshold value 9. Therefore, when the loom is restarted, weaving can be continued until the grand sum of penalties increases by another 4.

The short connection circuit 5 is arranged for the following reasons. Use of the short connection circuit 5 is suited for the above-described third basic rule in production plan. It is now assumed that the count (the grand sum of penalties) at the reversible counter C3 amounts to 6 and the allowable maximum value for B-grade is set to 17. When one heavy defect is produced under this condition, the count at the reversible counter C3 amounts to 16 far beyond the threshold value 9 for A-grade and a stop signal is issued to drive the loom stop circuit 3 for operation.

However, the count 16 at the reversible counter C3 is still below the threshold value 17 for B-grade and the count is still allowed to increase by 1 once degrading to B-grade is acceptable. So, if the above-described third rule is followed, it is advantageous from the viewpoint of production efficiency to continue the weaving until any next defect will be produced. To this end, the connection between the reversible counter C3 and the loom stop circuit 3 is provisionally cancelled by turning on the delay timer T3 by the stop signal from the reversible counter C3. Concurrently with this process, the weft detection units H1 and H2 are directly connected to the loom stop circuit 3 via the normally-open contact 32 which is now provisionally closed. When any defect is produced next, one pulse signal will be issued by either of the weft detection units H1 and H2 which drives the loom stop circuit for operation. The weaving is continued until this moment. Admittedly, the quality of the cloth produced is lower than A-grade.

On production of the next defect, the loom stop circuit 3 operates to stop the loom regardless of the extent of quality damage by the defect. Taking into account the length of cloth not yet woven, proper manual mending is employed at this stage of production and the count (the grand sum of penalties) at the reversible counter C3 is reduced by operating the gain allocation circuit 4. Thus, a cloth of B-grade is successfully produced whilst avoiding degradation to C-grade.

In the case of the embodiment shown in FIG. 5 in which only two weft detection units H1 and H2 are used, the system cannot well discern between an end blow-off (mode C) and a short pick (mode D) in FIG. 4 and equal penalties are allotted to these defects which are in fact different in extent of quality damage. In accordance with another aspect of the present invention, a wider variety of weft defects can be discriminated for different penalty allocation by properly increasing the number of weft detection units. One embodiment of this type is shown in FIG. 7 in which three weft detection units H1 to H3 are used in combination. This arrangement is able to discriminate seven modes of weft insertion shown in FIG. 6.

Figure 6:
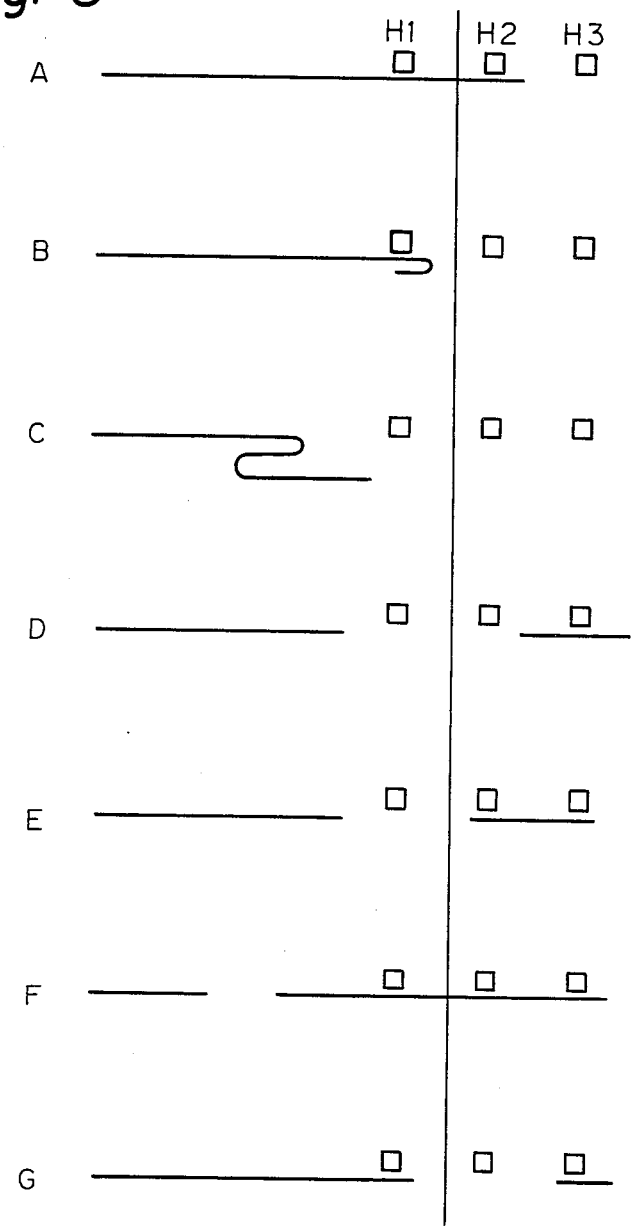
FIG. 6 is a plan view for showing another example of modes of weft insertion.
Figure 7:
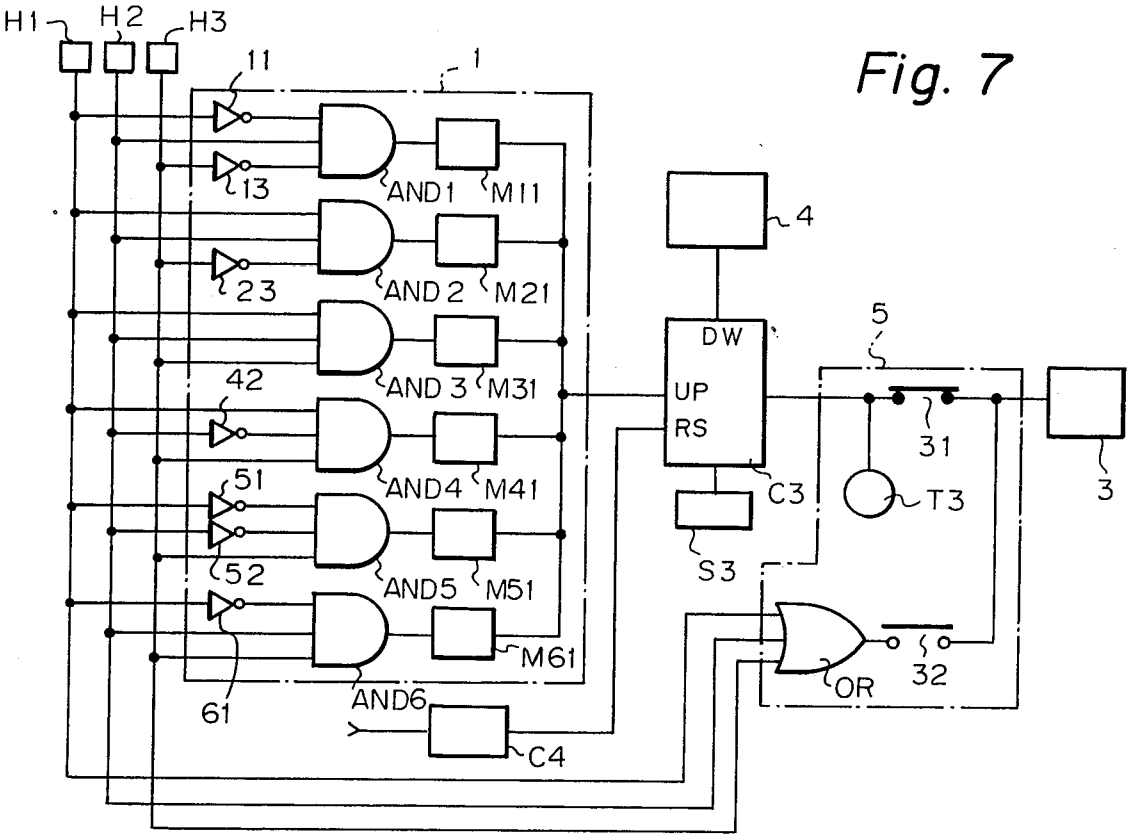
FIG. 7 is a circuit diagram of one example of the weft detection stopper in accordance with the present invention which carries out automatic defect inspection whilst discriminating the modes of weft insertion such as shown in FIG. 6.

In FIG. 6, A indicateds "normal weft insertion", B indicates a defect called "end turn-back", C indicates a defect called "intermediate folding", D, E and G indicate defects called "end blow-off", and F indicates a defect called "intermediate breakage".

The inside weft detection unit H1 is arranged on the inner side of the cloth edge whereas the middle and outside weft detection units H2 and H3 are arranged on the outer side of the cloth edge. Further, the outside weft detection unit H3 is arranged at a position beyond reach by the leading end of a normally inserted weft. In the case of "weft absent", each of the inside and middle weft detection units H1 and H2 issues a detection signal in the form of a pulse in order to indicate absence of weft. Whereas, in the case of "weft present", the outside weft detection unit H3 issues a detection signal in the form of a pulse in order to indicate presence of weft.

Issue of detection signals by the three weft detection units H1 to H3 for the modes of weft insertion shown in FIG. 6 is summerized in positive logic as follows;

| mode | unit | | |
|---|---|---|---|
| | H1 | H2 | H3 |
| A | 0 | 0 | 0 |
| B | 0 | 1 | 0 |
| C | 1 | 1 | 0 |
| D | 1 | 1 | 1 |
| E | 1 | 0 | 1 |
| F | 0 | 0 | 1 |
| G | 0 | 1 | 1 |

As is clear from the table, the combination of detection signals from the weft detection units H1 to H3 varries from mode to mode of weft insertion. Therefore, normal weft insertion can be successfully distinguished from production of various weft defects by properly processing defect signals which are formed by combinations of the detection signals.

One embodiment suited for such signal processing is shown in FIG. 7. In this case, a penalty allocation circuit 1 includes six AND-gates AND1 to AND6 and six pulse multipliers M11 to M61 connected to the output sides of the respective AND-gates. Like the arrangement shown in FIG. 5, rate of multiplication for each pulse multiplier can be freely adjusted by an attached setter (not shown).

The inside (first) weft detection unit H1 is connected to the AND-gates AND1, AND 5 and AND 6 via inverters 11, 51 and 61. The first weft detection unit H1 is further connected directly to the AND-gates AND2 to AND4. The middle (second) weft detection unit H2 is connected to the AND-gates AND4 and AND5 via inverters 42 and 52. The second weft detection unit H2 is further connected directly to the AND-gates AND1 to AND3 and AND6. The outside (third) weft detection unit H3 is connected to the AND-gates AND1 and AND2 via inverters 13 and 23. The third weft detection unit H3 is further connected directly to the AND-gates AND3 to AND6.

Like the embodiment shown in FIG. 5, a short connection circuit 5 includes a delay timer T3 connected to the output side of a reversible counter C3, normally-closed and normally-open contacts 31 and 32 and an OR-gate OR. The three weft detection units H1 to H3 are connected to the normally-open contact 32 via the OR-gate OR. Other constructions are the same as those in the arrangement shown in FIG. 5.

The operation will now be explained. The mode of signal processing in positive logic for the normal weft insertion (more A) in FIG. 6 is as follows;

| | AND1 | AND2 | AND3 | AND4 | AND5 | AND6 |
|---|---|---|---|---|---|---|
| From H1 | 1 | 0 | 0 | 0 | 1 | 1 |
| From H2 | 0 | 0 | 0 | 1 | 1 | 0 |
| From H3 | 1 | 1 | 0 | 0 | 0 | 0 |
| output from AND-gate | 0 | 0 | 0 | 0 | 0 | 0 |
| output from OR-gate | | | | 0 | | |

As is clear from the table, no AND-gates issue any defect signals, there is no output from the penalty allocation circuit 1 and the count at the reversible counter C3 remains unchanged. Since there is no output from the OR-gate OR, the loom stop circuit 3 does not operate even after degradation to B-grade.

The mode of signal processing in positive logic for the end turn-back (mode B) in FIG. 6 is as follows;

| | AND1 | AND2 | AND3 | AND4 | AND5 | AND6 |
|---|---|---|---|---|---|---|
| From H1 | 1 | 0 | 0 | 0 | 1 | 1 |
| From H2 | 1 | 1 | 1 | 0 | 0 | 1 |
| From H3 | 1 | 1 | 0 | 0 | 0 | 0 |
| output from AND-gate | 1 | 0 | 0 | 0 | 0 | 0 |
| output from OR-gate | | | | 1 | | |

In this case, the first AND-gate AND1 issues a defect signal which is passed to the first pulse multiplier M11. After allocation of a penalty special to this defect, a corresponding output from the penalty allocation circuit 1 is counted for addition at the reversible counter C3. Since the OR-gate OR also has an output, production of this defect after B-grade degradation instantly drives the loom stop circuit 3 for operation. In summary, the end turn-back (mode B) in FIG. 6 is detected by the first AND-gate AND1.

The mode of signal processing in positive logic for the intermediate folding (mode C) in FIG. 6 is as follows;

| | AND1 | AND2 | AND3 | AND4 | AND5 | AND6 |
|---|---|---|---|---|---|---|
| From H1 | 0 | 1 | 1 | 0 | 0 | 0 |
| From H2 | 1 | 1 | 1 | 0 | 0 | 1 |
| From H3 | 1 | 1 | 0 | 0 | 0 | 0 |
| output from AND-gate | 0 | 1 | 0 | 0 | 0 | 0 |
| output from OR-gate | | | 1 | | | |

In this case, the second AND-gate AND2 issues a defect signal which is passed to the second pulse multiplier M21. After allocation of a penalty special to this defect, a corresponding output from the penalty allocation circuit 1 is counted for addition at the reversible counter C3. Since the OR-gate OR also has an output, production of this defect after B-grade degradation instantly drives the loom stop circuit 3 for operation. In summary, the intermediate folding (mode C) in FIG. 6 is detected by the second AND-gate AND2.

The mode of signal processing in positive logic for the end blow-off (mode D) in FIG. 6 is as follows;

| | AND1 | AND2 | AND3 | AND4 | AND5 | AND6 |
|---|---|---|---|---|---|---|
| From H1 | 0 | 1 | 1 | 1 | 0 | 0 |
| From H2 | 1 | 1 | 1 | 0 | 0 | 1 |
| From H3 | 0 | 0 | 1 | 1 | 1 | 1 |
| output from AND-gate | 0 | 0 | 1 | 0 | 0 | 0 |
| output from OR-gate | | | 1 | | | |

In this case, the third AND-gate AND3 issues a defect signal which is passed to the third pulse multiplier M31. After allocation of a penalty special to this defect, a corresponding output from the penalty allocation circuit 1 is counted for addition at the reversible counter C3. Since the OR-gate OR also has an output, production of this defect after B-grade degradation instantly drives the loom stop circuit 3 for operation. In summary, the end blow-off (mode D) in FIG. 6 is detected by the third AND-gate AND3.

The mode of signal processing in positive logic for the first type intermediate breakage (mode E) in FIG. 6 is as follows;

| | AND1 | AND2 | AND3 | AND4 | AND5 | AND6 |
|---|---|---|---|---|---|---|
| From H1 | 0 | 1 | 1 | 1 | 0 | 0 |
| From H2 | 1 | 0 | 0 | 1 | 1 | 0 |
| From H3 | 0 | 0 | 1 | 1 | 0 | 1 |
| output from AND-gate | 0 | 0 | 0 | 1 | 0 | 0 |
| output from OR-gate | | | 1 | | | |

In this case, the fourth AND-gate AND4 issues a defect signal which is passed to the fourth pulse multiplier M41. After allocation of a penalty special to this defect, a corresponding output from the penalty allocation circuit 1 is counted for addition at the reversible counter C3. Since the OR-gate OR also has an output, production of this defect after B-grade degradation instantly drives the loom stop circuit 3 for operation. In summary, the first type intermediate breakage (mode E) in FIG. 6 is detected by the fourth AND-gate AND4.

The mode of signal processing in positive logic for the second type intermediate breakage (mode F) in FIG. 6 is as follows;

| | AND1 | AND2 | AND3 | AND4 | AND5 | AND6 |
|---|---|---|---|---|---|---|
| From H1 | 1 | 0 | 0 | 0 | 1 | 1 |
| From H2 | 1 | 0 | 0 | 1 | 1 | 0 |
| From H3 | 0 | 0 | 1 | 1 | 1 | 1 |
| output from AND-gate | 0 | 0 | 0 | 0 | 1 | 0 |
| output from OR-gate | | | 1 | | | |

In this case, the fifth AND-gate AND5 issues a defect signal which is passed to the fifth pulse multiplier M51. After allocation of a penalty special to this defect, a corresponding output from the penalty allocation circuit 1 is counted for addition at the reversible counter C3. Since the OR-gate OR also has an output, production of this defect after B-grade degradation in stantly drives the loom stop circuit 3 for operation. In summary, the second type intermediate breakage (mode F) in FIG. 6 is detected by the fifth AND-gate AND5.

The mode of signal processing in position logic for the third type intermediate breakage (mode G) in FIG. 6 is as follows;

| | AND1 | AND2 | AND3 | AND4 | AND5 | AND6 |
|---|---|---|---|---|---|---|
| From H1 | 1 | 0 | 0 | 0 | 1 | 1 |
| From H2 | 1 | 1 | 1 | 0 | 0 | 1 |
| From H3 | 0 | 0 | 1 | 1 | 1 | 1 |
| output from AND-gate | 0 | 0 | 0 | 0 | 0 | 1 |
| output from OR-gate | | | 1 | | | |

In this case, the sixth AND-gate AND6 issues a defect signal which is passed to the sixth pulse multiplier M61. After allocation of a penalty special to this defect, a corresponding output from the penalty allocation circuit 1 is counted for addition at the reversible counter C3. Since the OR-gate OR also has an output, production of this defect after B-grade degradation instantly drives the loom stop circuit 3 for operation. In summary, the third type intermediate breakage (mode G) in FIG. 6 is detected by the sixth AND-gate AND6.

In the above-described manner, the weft detection stopper shown in FIG. 7 exactly discriminates the seven modes of weft insertion shown in FIG. 6 and, upon production of each weft defect, allocates a corresponding penalty to the signal indicating that defect.

According to the above-described automatic inspection system, real time penalty allocation is carried out for defects produced during weaving of a cloth. As a consequence, the level of work is the same as that in the case of manual inspection. The mode of automatic inspection can be freely changed as desired by adjustment of setting at pulse multipliers and at the control counter, and selective addition of the gain allocation and/or short connection circuits to the penalty allocation circuit 1. Thus, in accordance with the present invention, flexible and optimum process control can be employed in response to any change in process conditions. Total labour for production can be reduced significantly.

We claim:

1. Weft detection stopper, comprising:

a plurality of weft detection units arranged side-by-side on a loom along the path of weft travel for producing a plurality of defect signals each representative of a weft defect in a cloth being woven;

a plurality of pulse multipliers, each of said pulse multipliers being connected to a different one of said plurality of weft detection units and alloting to each of said defect signals a penalty which is special to said weft defect thereby producing a plurality of corresponding penalty-loaded defect signals;

a control counter connected to said plurality of pulse multipliers for accumulating said plurality of penalty-loaded defect signals therefrom, said counter generating a stop signal when said accumulation has exceeded a threshold value; and a loom stop circuit responsive to said control counter for stopping the loom.

2. Weft detection stopper as claimed in claim 1 in which each of said pulse multipliers is connected to all of said weft detection units via an AND-gate.

3. Weft detection stopper, comprising:

a plurality of weft detection units arranged side-by-side on a loom along the path of weft travel for producing a plurality of defect signals each representative of a weft defect in a cloth being woven;

a penalty allocation circuit responsive to said plurality of weft detection units and alloting to each of said defect signals a penalty which is special to said weft defect thereby producing a plurality of corresponding penalty-loaded defect signals;

a reversible counter having an up-terminal connected to said penalty allocation circuit for accumulating said penalty-loaded defect signals therefrom, and a down-terminal;

an electric power source;

a plurality of pulse multipliers connected in parallel to each other and connected to said down-terminal of said reversible counter;

a plurality of manual switches each of which is interposed between said electric power source and one of said pulse multipliers for producing a plurality of gain-loaded mend sinals each representative of the correction of a weft defect in the cloth being woven;

said reversible counter performing subtraction of said gain-loaded mend signals from said accumulation, said counter generating a stop signal when said accumulation exceeds a threshold value; and a loom stop circuit responsive to said reversible counter for stopping the loom.

4. Weft detection stopper as claimed in claim 3, additionally comprising a delay timer connected to said reversible counter, a normally-closed contact of said delay timer interposed between said loom stop circuit and said reversible counter, and a normally-open contact of said delay timer interposed between said loom stop circuit and said plurality of weft detection units.

5. Weft detection stopper for looms, comprising:

a plurality of weft detection units arranged side-by-side on a loom along the path of weft travel for producing a plurality of defect signals each representative of a weft defect in a cloth being woven;

a penalty allocation circuit connected to said plurality of weft detection units and alloting to each of said defect signals a penalty which is special to said weft defect thereby producing a plurality of corresponding penalty-loaded defect signals;

a control counter connected to said penalty allocation circuit for accumulating said plurality of penalty-loaded defect signals therefrom, and generating a stop signal when said accumulation exceeds a threshold value;

a loom stop circuit responsive to said control counter;

a delay timer connected to said control counter;

a normally-closed contact of said delay timer being interposed between said loom stop circuit and said control counter; and a normally-open contact of said delay timer being interposed between said loom stop circuit and said plurality of weft detection units, whereby said contacts disconnect said loom stop circuit from said control counter and connect said loom stop circuit to said plurality of said weft detection units for a prescribed time after receipt of said stop signal from said control counter.

6. Weft detection stopper as claimed in claim 5 or 4, additionally comprising an OR-gate interposed between said normally-open contact of said delay timer and said plurality of weft detection units.

7. An apparatus for controlling the operation of a loom in response to the detection of weft defects, comprising:

a plurality of weft detection units arranged side-by-side on a loom along the path of weft travel for producing a plurality of defect signals each representative of a weft defect in a cloth being woven;

means for generating a plurality of mend signals each representative of the correction of a weft defect in the cloth being woven;

a reversible counter having an up-terminal connected to said weft detection units for accumulation of said defect signals, and a down-terminal connected to said means for generating a plurality of mend signals for subtracting said mend signals from said accumulation, said counter generating a stop signal when said accumulation exceeds a threshold value; and a loom stop circuit responsive to said reversible counter for controlling the operation of the loom.

8. An apparatus according to claim 7, additionally comprising a penalty allocation circuit responsive to said plurality of weft detection units for alloting to each of said defect signals a penalty which is special to said weft defect thereby producing a plurality of corresponding penalty-loaded defect signals, and a gain allocation circuit responsive to said plurality of mend signals for alloting to each of said mend signals a gain which is special to said corrected weft defect thereby producing a plurality of corresponding gain-loaded mend signals, and wherein said reversible counter is responsive to said penalty-loaded defect signals and said gain-loaded mend signals.

9. An apparatus according to claim 7, additionally comprising a short connection circuit connected between said reversible counter and said loom stop circuit and between said plurality of wedge detection units and said loom stop circuit for disconnecting said loom stop circuit from said reversible counter and connecting said loom stop circuit to said plurality of weft detection units for a prescribed time after receipt of said stop signal from said reversible counter.

* * * * *